US006671908B2

(12) United States Patent
Brown et al.

(10) Patent No.: US 6,671,908 B2
(45) Date of Patent: Jan. 6, 2004

(54) INFLATABLE SUPPORT PILLOW AND METHODS

(75) Inventors: Susan Matthews Brown, Evergreen, CO (US); Susan Ganter, Golden, CO (US)

(73) Assignee: The Boppy Company, Golden, CO (US)

( * ) Notice: Subject to any disclaimer, the term of this patent is extended or adjusted under 35 U.S.C. 154(b) by 0 days.

(21) Appl. No.: 10/046,377

(22) Filed: Oct. 26, 2001

(65) Prior Publication Data

US 2002/0108181 A1 Aug. 15, 2002

Related U.S. Application Data

(63) Continuation-in-part of application No. 09/799,759, filed on Mar. 6, 2001, now abandoned, which is a continuation of application No. 09/537,949, filed on Mar. 28, 2000, which is a division of application No. 09/265,163, filed on Mar. 9, 1999, now Pat. No. 6,055,687, which is a division of application No. 08/831,803, filed on Apr. 9, 1997, now abandoned, which is a continuation-in-part of application No. 08/590,653, filed on Jan. 24, 1996, now Pat. No. 5,661,861.

(51) Int. Cl.[7] ..... A47G 9/00
(52) U.S. Cl. ..... 5/644; 5/655.3; 5/711
(58) Field of Search ..... 5/644, 655.3, 711, 5/655, 490

(56) References Cited

U.S. PATENT DOCUMENTS

| | | | | |
|---|---|---|---|---|
| 682,871 A | | 9/1901 | Hogan et al. | |
| 1,343,357 A | | 6/1920 | Eggers | |
| 1,898,272 A | | 2/1933 | Stern | |
| 2,078,022 A | | 4/1937 | Roemer | |
| 2,379,340 A | | 6/1945 | Corbett | |
| 2,612,645 A | * | 10/1952 | Boland | 5/644 |
| 2,728,926 A | * | 1/1956 | Emery | 5/644 |
| 3,283,343 A | * | 11/1966 | Worcester | 5/644 |
| 3,378,948 A | | 4/1968 | Gervaise | |
| 3,503,084 A | * | 3/1970 | Meinwieser | 5/655.3 |
| 4,161,794 A | | 7/1979 | Darnfors | |
| 4,197,604 A | | 4/1980 | Nakamura | |
| D255,966 S | | 7/1980 | Stadel | |
| 4,236,264 A | | 12/1980 | Britzman | |
| 4,345,347 A | | 8/1982 | Kantor | |
| 4,731,890 A | | 3/1988 | Roberts | |
| 4,914,765 A | | 4/1990 | Smith | |
| 5,154,649 A | | 10/1992 | Pender | |

(List continued on next page.)

FOREIGN PATENT DOCUMENTS

| | | | |
|---|---|---|---|
| AU | 283611 A | * | 6/1966 |
| DE | 4205650 | | 11/1993 |
| FR | 1.430.355 | | 1/1965 |
| FR | 2 379 268 | | 1/1978 |
| GB | 1 508 809 | | 4/1978 |
| GB | 2 198 341 A | | 6/1988 |
| GB | 2205236 | | 12/1988 |
| IT | 467637 | | 12/1951 |
| WO | WO/94/09689 | | 5/1994 |

*Primary Examiner*—Alexander Grosz
(74) *Attorney, Agent, or Firm*—Townsend and Townsend and Crew LLP

(57) ABSTRACT

A support pillow comprises an inflatable pillow body having an interior that is adapted to be filled with a fluid to inflate the pillow body, a top side, a bottom side, and at least one wall disposed in the interior and that connects the top side to the bottom side to facilitate flattening of the top and the bottom sides when the pillow body is inflated. The pillow body further comprises a medial region and first and second opposing arms extending from the medial region, with the arms having respective first and second end portions remote from the medial region. Further, the cantilever arms are curved about a vertical axis, and the cantilever arms and medial region cooperate to define an open well.

8 Claims, 10 Drawing Sheets

U.S. PATENT DOCUMENTS

| | | | | | |
|---|---|---|---|---|---|
| 5,193,235 | A | | 3/1993 | Kircher | |
| 5,207,791 | A | | 5/1993 | Scherbarth | |
| 5,261,134 | A | | 11/1993 | Matthews | |
| 5,519,906 | A | | 5/1996 | Fanto-Chan | |
| 5,546,620 | A | | 8/1996 | Matthews | |
| 5,581,833 | A | | 12/1996 | Zenoff | |
| 5,661,861 | A | | 9/1997 | Matthews | |
| 6,038,720 | A | | 3/2000 | Matthews et al. | |
| 6,055,687 | A | | 5/2000 | Matthews | |
| 6,119,873 | A | | 9/2000 | Matthews | |
| 6,131,219 | A | * | 10/2000 | Roberts | 5/644 |
| 6,233,767 | B1 | | 5/2001 | Horowitz | 5/644 |
| 6,487,737 | B1 | * | 12/2002 | Futagami | 5/644 |

* cited by examiner

Fig. 12
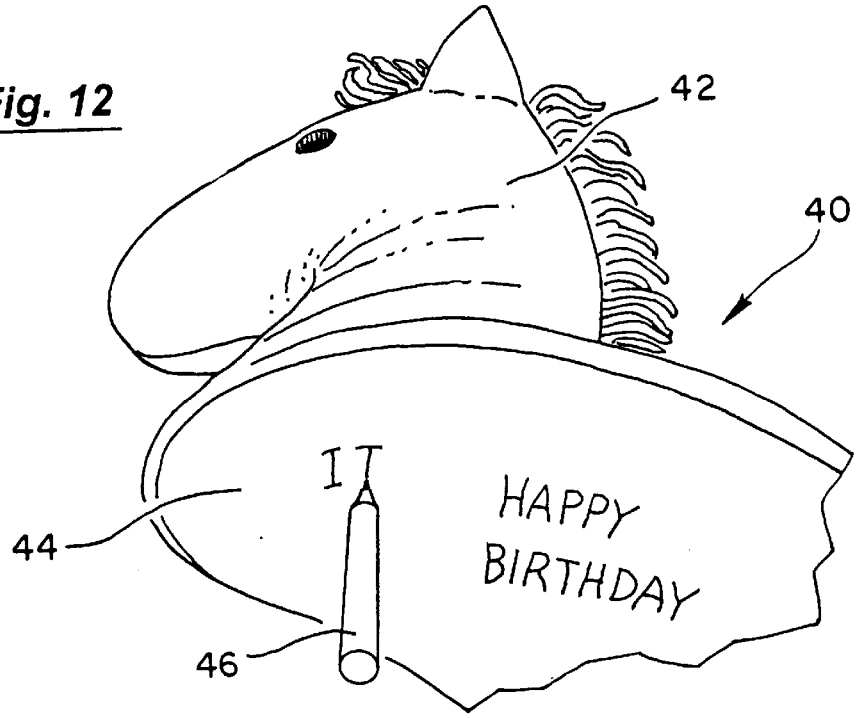
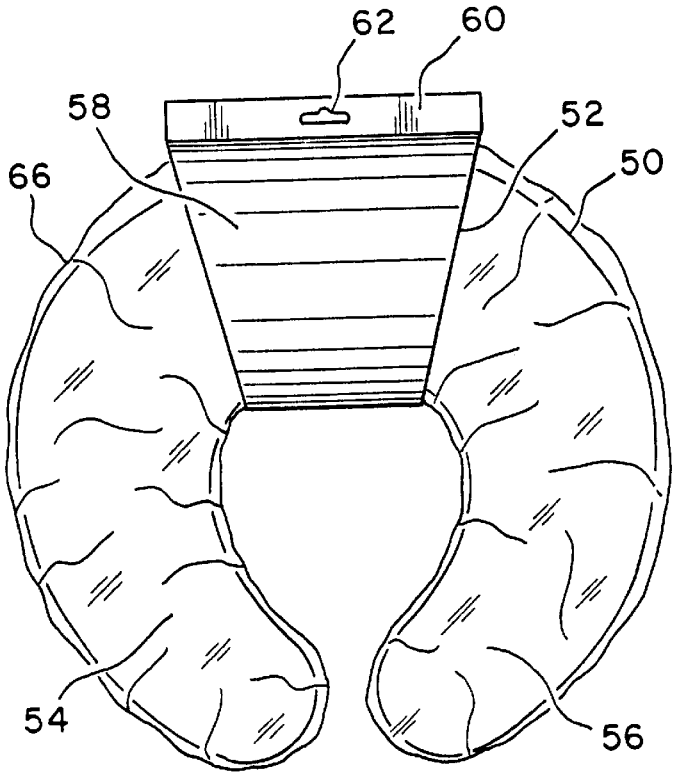
Fig. 13
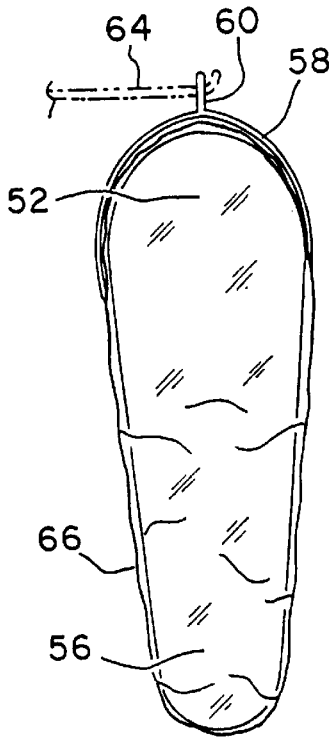
Fig. 14

INFLATABLE SUPPORT PILLOW AND METHODS

CROSS-REFERENCES TO RELATED APPLICATIONS

This application is a continuation-in-part application of U.S. patent application Ser. No. 09/799,759, filed Mar. 6, 2001 now abandoned which is a continuation application of U.S. patent application Ser. No. 09/537,949, filed Mar. 28, 2000, which is a divisional application of U.S. patent application Ser. No. 09/265,163, filed Mar. 9, 1999 (now U.S. Pat. No. 6,055,687), which is a divisional application of U.S. patent application Ser. No. 08/831,803, filed Apr. 9, 1997 (now abandoned), which is a continuation-in-part application of U.S. patent application Ser. No. 08/590,653, filed Jan. 24, 1996 (now U.S. Pat. No. 5,661,861), the complete disclosures of which are herein incorporated by reference.

BACKGROUND OF THE INVENTION

The present invention relates generally to the field of therapeutic support pillows, and in particular to support pillows and methods for their use which are intended as improvements to the support pillow and methods described in U.S. Pat. No. 5,261,134, the complete disclosure of which is herein incorporated by reference.

U.S. Pat. No. 5,261,134 describes a therapeutic support pillow which is provided to support a small child or an infant, and particularly to hold a small child in a manner that prohibits lateral movement. Although the support pillow described in U.S. Pat. No. 5,261,134 has been generally successful when used to prohibit the lateral movement of a small child, various improvements are desired. For example, it would be desirable if such a support pillow could be used with an adolescent or an adult. For some applications, it would be further desirable if improvements could be made to the overall structure of the support pillow.

Many adults or adolescents participate in activities which make it desirable to support certain objects or body parts. For example, with activities such as reading, typing, breast feeding, and the like, it is often desirable to support the arms or elbows. As another example, when sleeping in an upright position it is often desirable to have the neck and head supported. As a further example, it is often desirable to provide support to the lower back.

Although some support structures have been proposed for supporting objects or body parts, such as the arms of a chair or certain braces, such structures are often uncomfortable and inconvenient to use. Further, some support structures are not easily portable, thereby limiting their use. In a further drawback, most support structures are designed only for a particular application and do not have multiple uses.

For these and other reasons, it would be desirable to provide an improved support pillow and methods which would overcome these and other drawbacks. In particular, it would be desirable if such a support structure and methods were capable of supporting certain small objects or body parts, such as the arms, elbows, lower back, neck or head. Such a support pillow and methods should be comfortable, portable, and easy to use. In one particular aspect, it would be desirable if such a support pillow could be used in a variety of applications to support certain objects or body parts.

BRIEF SUMMARY OF THE INVENTION

The invention provides a support pillow and methods for its use. In one exemplary method, support is provided to a person's lower back. According to this method, a support pillow is provided having a resilient cushion body with a medial region and first and second opposing cantilever arms extending from the medial region. The cantilever arms have respective first and second end portions remote from the medial region. The cantilever arms are curved about a vertical access to define a substantially toroidal configuration for the cushion body and to position the first and second end portions in a confronting relation to one another. The cantilever arms and medial region cooperate to define a generally circular open well. Such a support pillow is placed around the person's torso in the area of the lower back. The first and second end portions of the cantilever arms are positioned in front of the person's torso, and the medial region of the support pillow is positioned adjacent the person's lower back. The cantilever arms are biased around the person's torso to hold the support pillow vertically positioned relative to the person's torso while the medial region is positioned against the person's lower back. In this manner, the support pillow may be employed to support the person's lower back even when the person is in various positions. For example, the support pillow may be used to support the lower back when the person is sitting in an upright position, such as when sitting in a chair. Alternatively, the support pillow may provide support to the person's lower back while the person is lying.

In one particular aspect, the support pillow is removably held within a flexible container having a bottom end, at least one side and an open top. A base member is held within the bottom end of the container. With this configuration, the base member holds the container in a vertical orientation when the bottom end rests upon a surface, thereby providing a convenient way to store the support pillow. To use the support pillow, the user simply removes the support pillow from the container and then places the pillow around the torso. Preferably, the container comprises a clear polymer and the base member is constructed of a paper material. Optionally, the top end may be provided with a snapable handle which provides a way to both carry the pillow and to close the top end of the container.

In another exemplary method, such a support pillow may be placed around the person's torso, with the first and second end portions of the cantilever arms being at the back of the person's torso, and with the medial region of the support pillow being adjacent the front of the person's torso. The cantilever arms are biased around the person's torso to hold the support pillow vertically positioned relative to the person's torso. With the support pillow placed around the person's torso in this manner, an object may be rested on the cantilever arms or the medial region while the cantilever arms are biased around the person's torso.

For example, the person may be sitting while resting the object on the cantilever arms. In one exemplary aspect, the object is printed material, such as a book, that is rested on the medial region. Alternatively, other objects such as games, food, video game controls, and the like, may be rested on the medial region. In a further aspect, the person's elbows or forearms are rested on the medial region. Resting of the person's forearms or elbows in this manner is advantageous when performing a variety of activities with the hands, such as typing on a keyboard, breast feeding a baby, and the like.

In yet another exemplary method, such a support pillow is provided to support a person's neck and head. According to the method, the support pillow is placed around the person's neck with the first and second end portions of the cantilever arms being at the front of the person's neck. The medial region of the support pillow is positioned adjacent the back of the person's neck. The cantilever arms extend around the person's neck so that the neck is supported at least in part by the cantilever arms in the medial region.

In one aspect, the support pillow is positioned so that the cantilever arms rest on the person's shoulders. In another aspect, the person's head is tilted so as to rest the person's neck and head against the support pillow in the region of the open well. For example, the support pillow may be employed to support the person's neck and head while sitting in a chair or other location where the person's head may be supported when titled. Alternatively, the support pillow may be employed to support the person's neck while lying down.

The invention provides an exemplary support pillow having a resilient cushion body, a medial region and first and second opposing cantilever arms extending from the medial region. The cantilever arms have respective first and second end portions remote from the medial region. The cantilever arms are curved about a vertical axis to define a substantially toroidal configuration for the cushion body and to position the first and second end portions in a confronting relation to one another. The cantilever arms and medial region cooperate to define a generally circular open well. At least a portion of the cushion body is covered with a material suitable for receiving a marking substance from a writing instrument such as a pen, marker, or the like. Preferably, such a material comprises a fabric having a smooth surface (such as satin, rip-stop nylon, and the like) and covers a bottom portion of the cushion body. In this way, the support pillow may be employed to receive an autograph or other message by simply turning the support pillow on its side or top and writing on the bottom portion.

In a preferable aspect, a head member is further provided and is attached to the cushion body. The head member will preferably be attached to one of the cantilever arms such that the head member extends in a direction generally parallel to the vertical axis. In one particular aspect, the head member is in the shape of a unicorn.

The invention provides one particularly preferable embodiment of a support pillow which may be used in a liquid medium, such as water. The support pillow comprises a resilient cushion body having a medial region and first and second opposing cantilever arms extending from the medial region. The cantilever arms have respective first and second end portions remote from the medial region, with the cantilever arms being curved about a vertical axis to define a substantially toroidal configuration for the cushion body and to position the first and second end portions in a confronting relation to one another. The cantilever arms and medial region cooperate to define a generally circular open well. The cushion body is constructed of a sponge material so that the cushion body may be placed in a liquid medium. In this way, the support pillow may be placed around the torso of a person when bathing, with the support pillow maintaining the person in a generally upright position. Alternatively, the support pillow may be placed on the bottom of the bath tub, with the person's head being supported by the medial region.

The invention still further provides a support pillow which conveniently may be provided in kit form. The pillow comprises a pillow body having a medial region and a pair of opposing arms. Further, a central holder is removably secured to the medial region of the pillow body to provide a convenient way to carry and store the support pillow.

In one particular aspect, the central holder comprises a piece of material, such as a paper product, which encircles the medial region. Preferably, the holder includes at least one aperture which is adapted to receive a hanger to hang the support pillow, thereby providing a convenient way to both store and display the support pillow. Optionally, a protective cover, such as a plastic, may be provided to encompass the support pillow.

The invention further provides an exemplary method for storing a support pillow having two opposing arms and a medial region. According to the method, a central holder is placed around the medial region and a hanger is introduced through the central holder to allow the support pillow to hang from the hanger. In this way, the hanger may be employed to conveniently store and display the support pillow. For example, the support pillow may be display along a store aisle to allow a purchaser to easily visualize the support pillow and then remove the support pillow from hanger for purchase.

In a further exemplary embodiment, a support pillow is provided comprising a resilient cushion body and at least one strap which is attached to the cushion body. The strap is configured to attach an article, such as a child's toy, to the cushion body.

In a preferable aspect, the pillow includes two or more straps so that a variety of toys may be attached to the pillow. Further, the pillow will preferably be fashioned to include a medial region and first and second arms extending from the medial region to define a generally circular open well. With this arrangement, the straps are attached to the medial region so that a child may lay on the pillow, with the stomach being over the well, and play with the toys that are attached to the pillow. The straps are therefore advantageous in that they hold the toys close to the pillow so that the child will not push the toys out of reach during play.

The straps may be configured in a variety of ways to hold the toys to the pillow. For example, the toys could be tied to the pillow with the straps. Preferably, each strap will include a fastener which allows the strap to be formed into a loop to secure the article. For instance, each strap may be provided with a hook and loop fastener. In this way, the toys will be removably attached to the pillow to allow for convenient removal and replacement of the toys.

In another embodiment, the support pillows of the invention may be inflatable. In this way, the pillows may be deflated during storage to save space, and then inflated when needed. Manufacturing costs may also be reduced. The inflatable support pillows may be inflated to any of the shapes described herein, and may be used for any of the applications described herein. Optionally, a fabric cover may be provided over the support pillow.

The inflatable support pillows in one embodiment may be constructed of a flexible material that defines an interior that may be filled with a fluid. An inflation port may be provided to permit easy inflation and deflation. In some cases, one or more walls may be positioned in the interior and attached to top and bottom sides of the pillow body. In this way, when the pillow is inflated, the walls help to limit the amount of curvature of the top and bottom sides. This generally flattens the top and bottom sides to facilitate placement of objects onto the surfaces, such as when resting a baby during nursing.

BRIEF DESCRIPTION OF THE DRAWINGS

FIG. 12 illustrates a bottom portion of the support pillow of FIG. 9 which is constructed of a material suitable for receiving a marking substance from a writing instrument according to the present invention.

FIG. 13 is a front view of a support pillow having a central holder to allow the support pillow to be conveniently hung and displayed according to the invention.

FIG. 14 is a side view of the support pillow of FIG. 13.

DESCRIPTION OF THE SPECIFIC EMBODIMENTS

Figure 1:
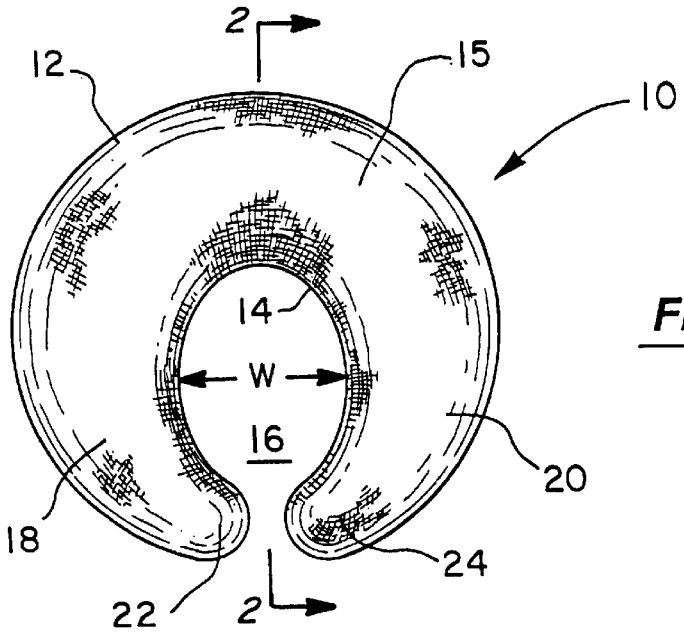
FIG. 1 is a top view of a support pillow constructed in accordance with the present invention.

Referring to FIG. 1, an exemplary embodiment of a support pillow 10 will be described. The support pillow 10 may be constructed essentially identically to the support pillow described in U.S. Pat. No. 5,261,134, previously incorporated herein by reference. The support pillow 10 includes a curved outer surface 12 which is rounded in both a longitudinal and a lateral direction. The support pillow 10 further includes a curved central inner surface 14 which defines a rounded, generally circular or elliptical well region 16. While the body of the support pillow 10 is substantially continuous and uniform, with curved surfaces 12 and 14 also being continuous, it is convenient to consider the pillow body as consisting of a medial region 15, and two opposed cantilever arms 18 and 20. The arms 18, 20 extend in opposite directions away from the medial region 15, but are curved towards one another to give the pillow 10 its toroidal configuration. While the continuous structure does not provide a precise or exact division between the medial region 15 and each arm, considering the body of the pillow in view of these components facilitates a description of the structure and function of the pillow 10.

Cantilever arms 18, 20 include respective blunt ends 20 and 24, positioned remotely of the remedial region. The support pillow 10 is proportioned so that ends 22, 24 normally, i.e., when not under external stress, touch one another. However, the ends 22, 24 do not exert substantial pressure against each other. The toroidal shape defined by the outer and inner curved surfaces 12, 14 is proportioned such that at a central vertical plane, represented by line 2—2 in FIG. 1, bisects the pillow 10 at the medial region 15. Pillow 10 thus has bilateral symmetry with respect to the central plane. The central plane further contains a vertical, central axis about which the toroidal pillow body is formed. Profiles of the pillow 10 taken radially of the central axis, i.e., sections of the pillow 10 in planes that also contain the central axis, are elliptical in shape throughout the medial region, and likewise are elliptical throughout the length of each cantilever arm 18, 20 with the exception of blunt ends 22, 24.

Well region 16 has a width W in the direction perpendicular to the central plane. The width W will preferably be in the range from about four to about twelve inches, and more preferably from about four to about eight inches, with a particularly preferred width being about six inches. Such a width will enable the support pillow to fit "snug" around the torso or waist of most users. The pillow preferably has a circumference of about 15 to 30 inches, and more preferably about 21 inches. As will be described in greater detail hereinafter, the pillow 10 is constructed so that the arms 18, 20 may be moved away from each other to vary the width W so that the pillow 10 may be used in a variety of applications.

Figure 2:
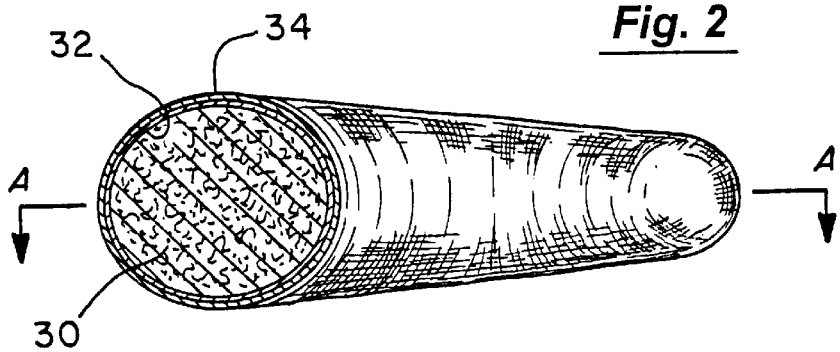
FIG. 2 is a cross-sectional side view of the support pillow of FIG. 1 taken along lines 2—2.

Referring to FIG. 2, the pillow 10 includes a central core 30 which is constructed of a resilient, compression resistant, hypoallergenic material, such as a polyester filling. The central core 30 is encased in a lining 32, such as cotton or other pliant conforming fabric. The polyester is firmly and tightly packed into lining 32, such that the core 30 and lining 32 together provide a self-supporting pillow body, i.e., the support pillow 10 retains its shape without any sagging or drooping of the cantilever arms 18, 20 when held at the medial region 15. The tightly packed polyester core 30 also provides the pillow with firmness in the sense that it will undergo only slight elastic deformation (as compared to a conventional pillow) when an object (such as a persons' arms or elbows) is rested on the arms 18, 20 or medial region. Covering the lining 32 is a conforming, removable exterior covering 34, also preferably constructed of cotton. The elliptical profile i.e., the profile in the central plane, preferably has a vertical height of about four to eight inches, and preferably at about six inches. Line A—A in FIG. 2 represents a horizontal mid-plane, with the top and bottom halves of pillow 10 being symmetrical about the mid-plane.

Figure 3:
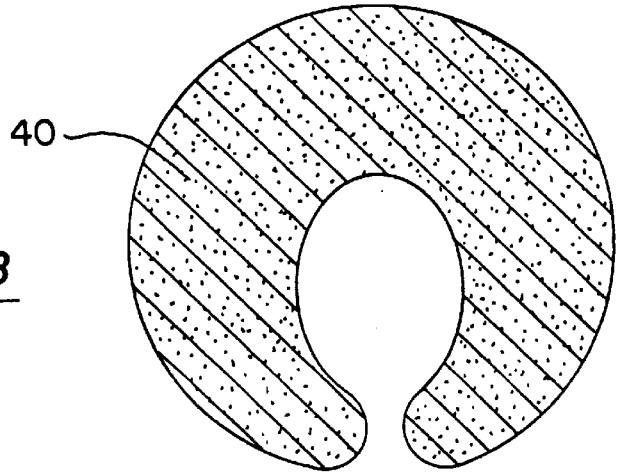
FIG. 3 is a cross-sectional top view of an alternative embodiment of a support pillow according to the present invention.

FIG. 3 illustrates an alternative embodiment of a support pillow 40. Support pillow 40 is constructed of a sponge material or other porous material (such as a foamed rubber). The sponge material will preferably provide substantially the same type of support as described in connection with the support pillow of FIG. 1. Constructing the pillow 40 of a sponge material allows the support pillow to be placed in liquids, such as water. For example, the support pillow may be placed around the waist or torso of a person (particularly an infant or a small child) when bathing. The support pillow holds the person upright to prevent the person from falling or slipping while within the bathtub. This is particularly advantageous when attempting to bathe a small child, who may be slippery due to water or soap on the skin. After bathing, the support pillow may be removed from the person, wrung out, and left in the tub to dry.

Figure 3A:
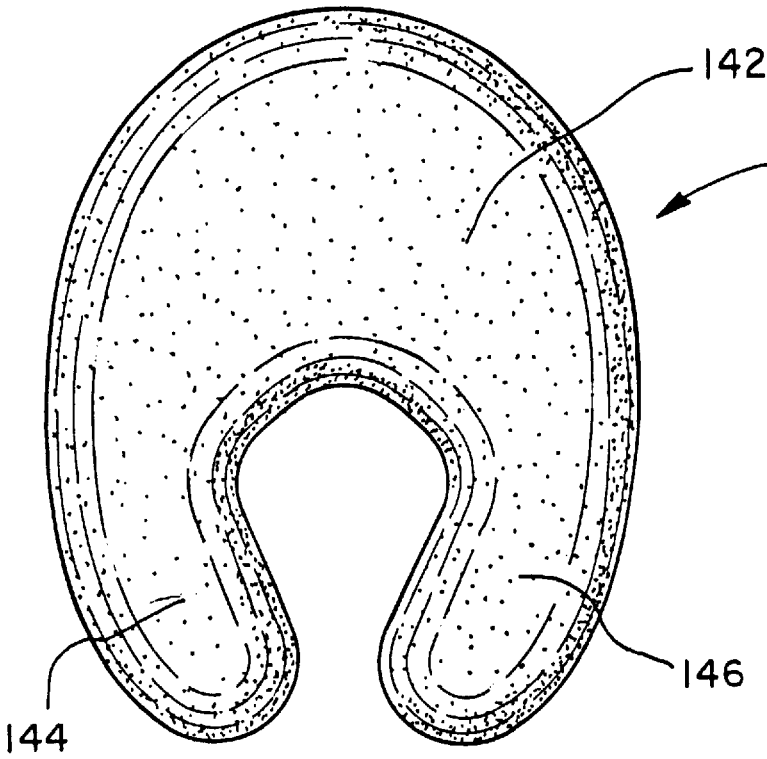
FIG. 3A is a top view of a further alternative embodiment of a support pillow according to the invention.
Figure 3B:
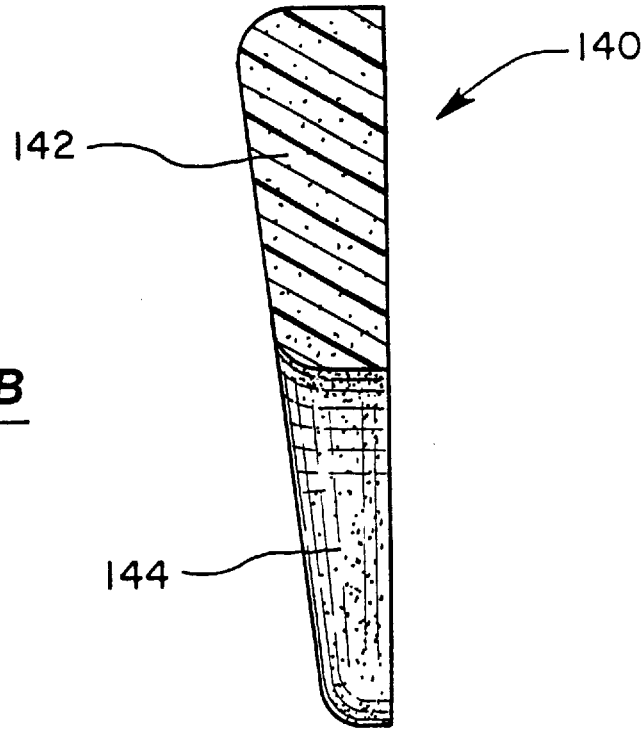
FIG. 3B is a cross-sectional side view of the support pillow of FIG. 3A.

Referring to FIGS. 3A and 3B, an alternative embodiment of a support pillow 140 which may be used in a liquid environment, such as when bathing, will be described. Support pillow 140 is preferably constructed of a sponge material, polyurethane foam or the like so that it may be used in water. Alternatively, support pillow 140 may be inflatable to its illustrated configuration. For example, the pillow may be constructed of a rubber or vinyl material which is inflated similar to pool toys.

Pillow 140 includes a medial region 142 and a pair of arms 144 and 146. As best shown in FIG. 3B, pillow 140 tapers from medial region 142 to arms 144 and 146. Also, arms 144 and 146 are spaced apart from each other. When configured in this manner, pillow 140 will preferably be used by placing the pillow on a bottom surface of a bath tub, large sink, or the like. A person is then placed on their back, with medial region 142 supporting the head. Pillow 142 will preferably have a height sufficient to keep the person's head from being covered by water when in such a position. With an infant or small child, arms 144 and 146 will tend to hold the person's torso stationary so that they will not roll off pillow 140. Optionally, pillow 140 could be placed around a person's waist similar to the other embodiments described herein. Also, a person could lay supine or sideways on the pillow.

Although the size of pillow 140 will vary depending on the size of the person using the pillow, some exemplary size ranges are as follows. Medial region 142 will preferably have a depth in the range from about 4 inches to about 15 inches, and more preferably about 9 inches. Arms 144 and 146 will preferably be spaced-apart by about 0.5 inch to about 6 inches, and more preferably at about 3 inches. Medial region 142 will preferably have an average thickness of about 2 to about 6 inches, and more preferably about 4 inches.

Figure 4:
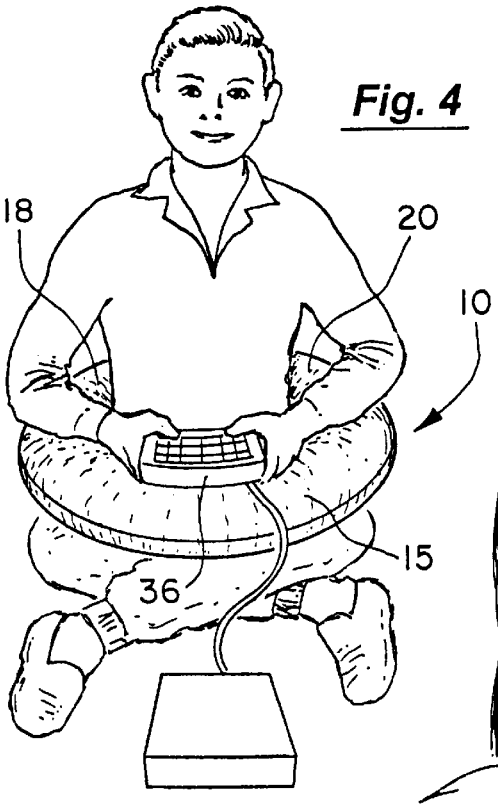
FIGS. 4 and 5 illustrate one exemplary use of the support pillow of FIG. 1 when placed around a person while in a sitting position.
Figure 5:
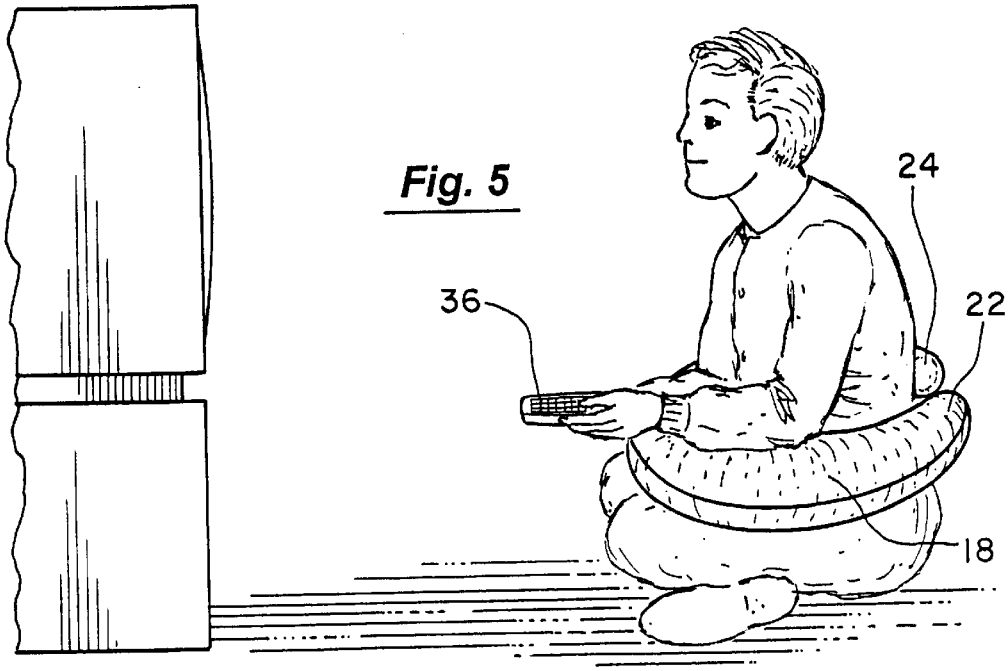

Referring now to FIGS. 4 and 5, an exemplary method for using the support pillow 10 will be described. In FIGS. 4 and 5, the support pillow 10 is placed around a person's torso with the medial region 15 being at the front of the person's torso. The cantilever arms 18, 20 extend around the side of the person's torso, with the ends 22, 24 being at the back of the person's torso. As previously described, the arms 18, 20 are resilient so that they may be moved away from each other. In this way, the pillow 10 may be positioned around the person's torso by grasping the arms 18, 20 and pulling them away from each other while sliding the ends 22, 24 around the person's torso. The arms 18, 20 are sufficiently biased so that the pillow 10 will remain vertically secured to the person's torso by the arms 18, 20. Preferably, the support pillow 10 will be positioned around the person's torso just above the waist, with the waist and the person's thighs helping to prevent the support pillow 10 from sliding down the person's waist when a force is applied to the top surface of the pillow 10.

In FIGS. 4 and 5, the person is in a sitting position, with the bottom of the support pillow 10 resting upon the person's knees and legs. In this configuration, the person may rest the elbows or forearms on the cantilever arms 18, 20 and/or the medial region IS to support the person's arms while operating a keyboard 36, a computer game, an electronic device, or the like 36. When resting the elbows and/or the forearms on the support pillow 10, the support pillow 10 will experience only slight deformation so that sufficient support is provided to the person's arms while also providing a comfortable support surface. Optionally, the keyboard 36 itself may be directly rested on the support pillow 10, such as on the medial region 15 when operating the keyboard 36.

The support pillow 10 will preferably be constructed so that a single size may be used for most people. In some circumstances, however, it may be advantageous to vary the dimensions of the pillow 10 to fit the particular person.

Figure 6:
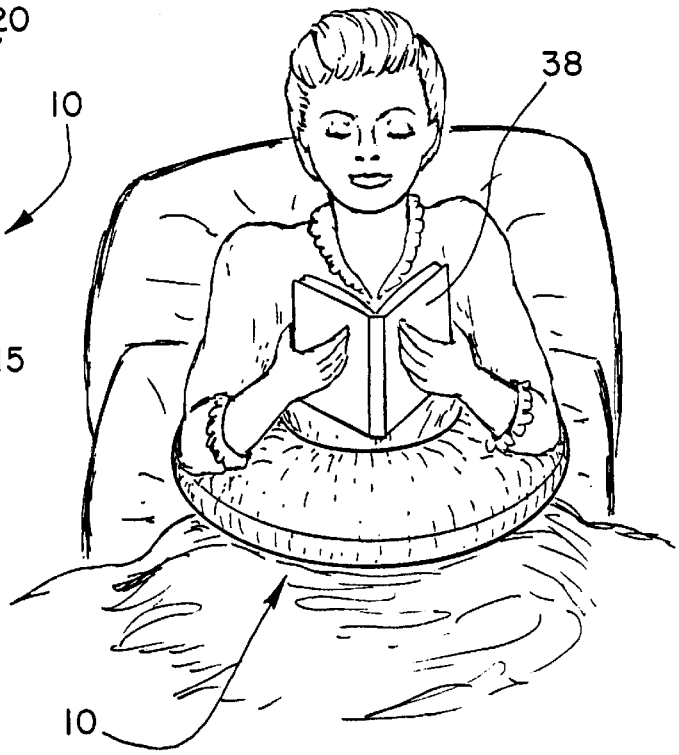
FIG. 6 illustrates a further exemplary method for using the support pillow of FIG. 1 to support an object in front of a person's torso according to the present invention.

Referring to FIG. 6, an alternative use of the support pillow 10 will be described. In FIG. 6, the support pillow 10 is placed around a person's torso in a manner similar as that previously described in FIGS. 4 and 5. The person will preferably be in a sitting position, with the support pillow 10 around the torso and being supported by the person's thighs. The person's elbows are rested on the support pillow at the cantilever arms 18, 20 or at the medial region 15 to provide support to the person's arms while reading a book 38 or other printed material. The vertical position of the support pillow 10 relative to the person's torso may be adjusted to place the book 30 at a comfortable reading position.

Figure 7:
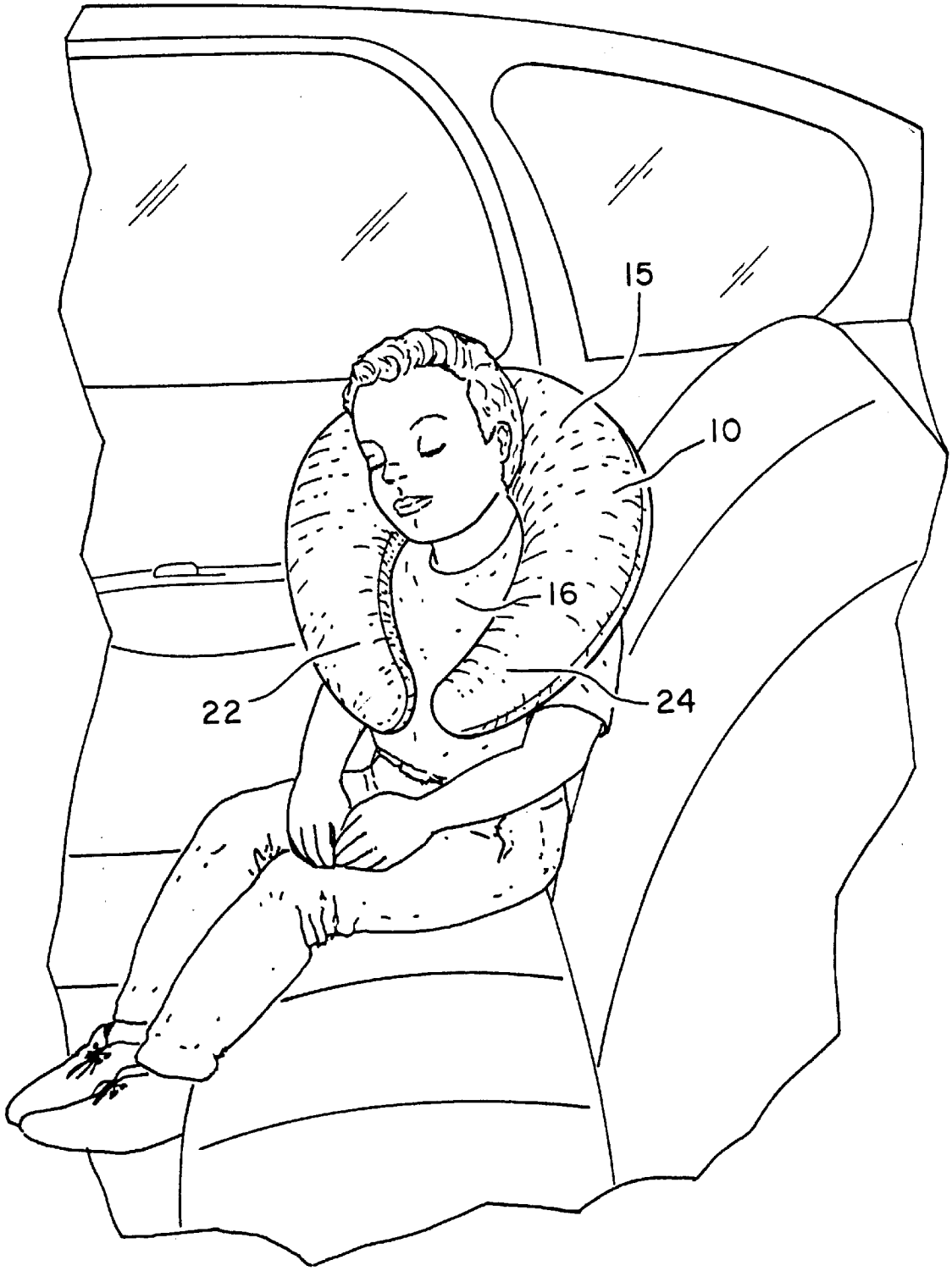
FIG. 7 illustrates yet another use of the support pillow of FIG. 1 for supporting a person's neck and head according to the present invention.

Referring to FIG. 7 still yet another exemplary use of the support pillow 10 will be described. In FIG. 7, the support pillow 10 is placed around a person's neck, with the medial region 15 being at the back of the person's head and the ends 22, 24 being in front of the person's neck. The well region 16 is sufficiently sized so that the support pillow 10 will not choke or interfere with the breathing of the person. The support pillow 10 is placed around the person's neck by pulling the ends 22, 24 away from each other and sliding the ends 22, 24 around the neck. When placed around the neck, the support pillow 10 rests upon he person's shoulders so that when the person's head is tilted, the person's neck or head will rest against the support pillow 10 in the region of the open well 16. The support pillow 10 ay be used to support a person's neck or head when the person is in virtually any position, such as lying, sitting, or the like. When around the neck, the support pillow 10 is particularly useful when the person is sitting in a chair or other supporting member, such as when in an airplane or an automobile as shown in FIG. 7. When sitting in an upright position, it is often difficult to sleep comfortably since little support is provided to the head and neck. When the support pillow 10 is around a person's neck, the person may comfortably sleep in an upright position, with the support pillow 10 providing sufficient support to the neck and head.

Figure 8:
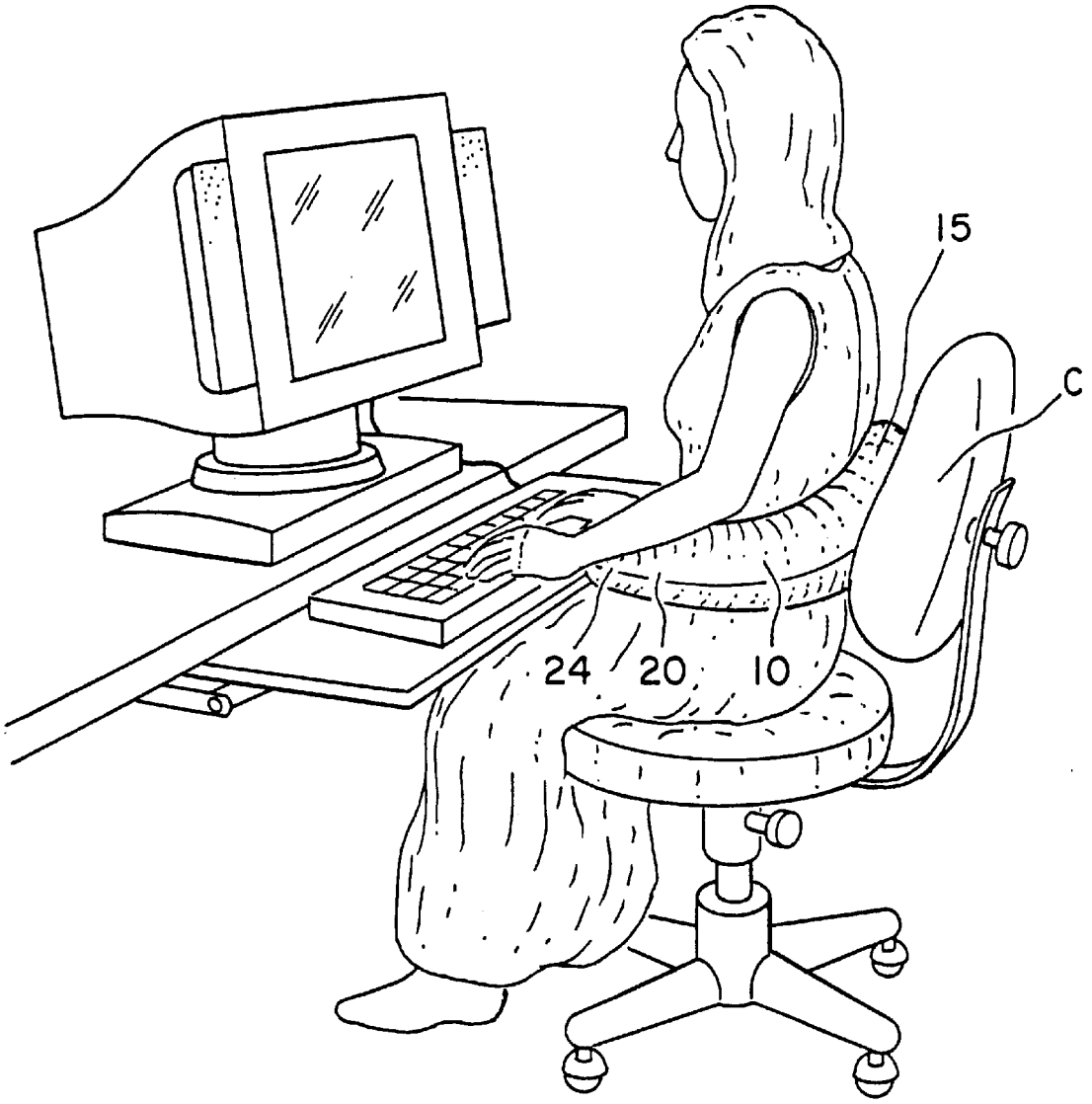
FIG. 8 illustrates still yet another use of the support pillow of FIG. 1 for supporting a person's lower back according to the present invention.

Referring to FIG. 8, still yet another exemplary method for using the support pillow 10 will be described. In FIG. 8, the support pillow 10 is placed around a person's torso with the medial region 15 being at the back of the person's torso, and the ends, 22, 24 being at the front of the person's torso. The medial region 15 will preferably be positioned in the area of the lower back, such as at the lumbar region, so that the support pillow may provide support to the person's lower back. The support pillow 10 is placed around the person's torso in a manner similar to that previously described in connection with FIGS. 4 and 5. The arms 18, 20 are sufficiently resilient so as to hold the support pillow in a constant vertical position relative to the person's torso.

The support pillow 10 may be used to provide support to the lower back when the person is in a variety of positions, such as when lying, sitting, and the like. The support pillow 10 will be particularly useful when sitting in a chair C with the outside surface 12 of the pillow being positioned against the back of the chair C. In this way, the inner surface 14 will be biased against the person's lower back. The support pillow 10 will undergo only slight elastic deformation when positioned against the person's back so that sufficient support will be provided to the lower back. At the same time, the support pillow 10 is sufficiently resilient so that the support will be comfortable to the person. A further advantage of support pillow 10 is that it will snugly fit around the person's torso so that when the person twists or moves about, the support pillow 10 will generally maintain its position about the person's torso. As shown in FIG. 8, arms 22, 24 are available to support the person's arms, such as when typing.

Figure 9:
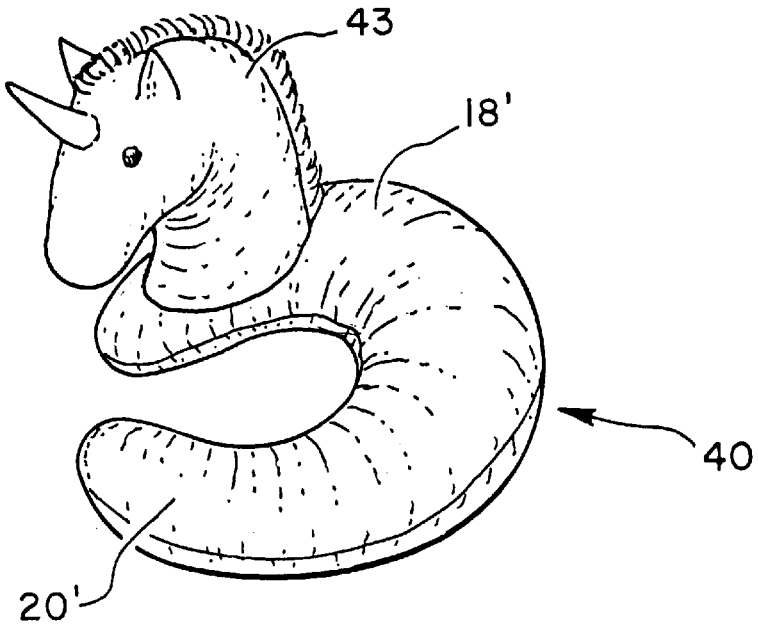
FIG. 9 illustrates an alternative embodiment of a support pillow having a head member attached to one of the cantilever arms according to the present invention.

Referring to FIG. 9, an alternative embodiment of a support pillow 40 will be described. The support pillow 40 may be constructed essentially identically to the support pillow of FIGS. 1–3 except that the support pillow 40 includes a head member 42 which is attached to one of the cantilever arms 18'. Alternatively, the head member 42 may be attached to the pillow 10 anywhere along the top surface, with the head member 42 preferably being generally parallel to a vertical axis of the support pillow 40. Although shown with the head of a unicorn, the head member 42 may include the head of virtually any animal or other figure. The head member 42 will preferably be filled with the same materials used to make the central core 30 of the support pillow 10. In this manner, the head member 42, will be soft and cushiony but will also be sufficiently rigid to be self-supporting. The support pillow 10 will also include a portion suitable for receiving a marking substance from a writing instrument as described in connection with FIG. 12.

Figure 10:
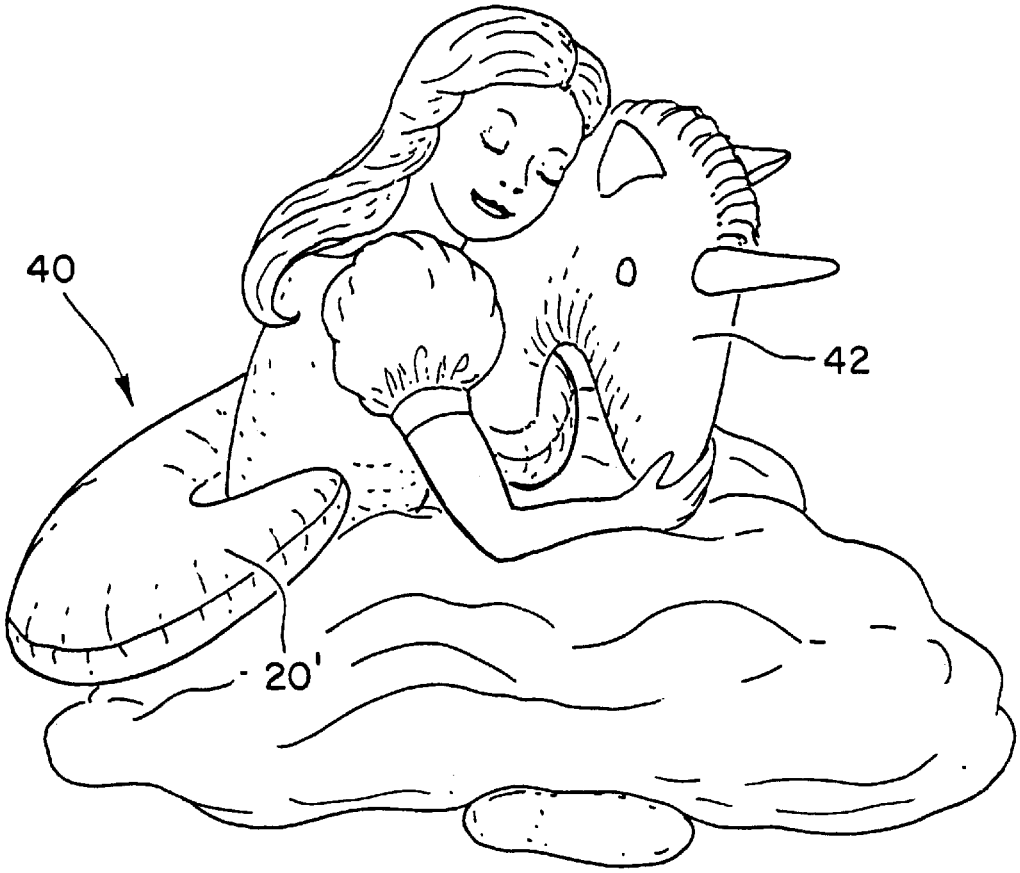
FIGS. 10 and 11 illustrate exemplary uses of the support pillow of FIG. 9.
Figure 11:
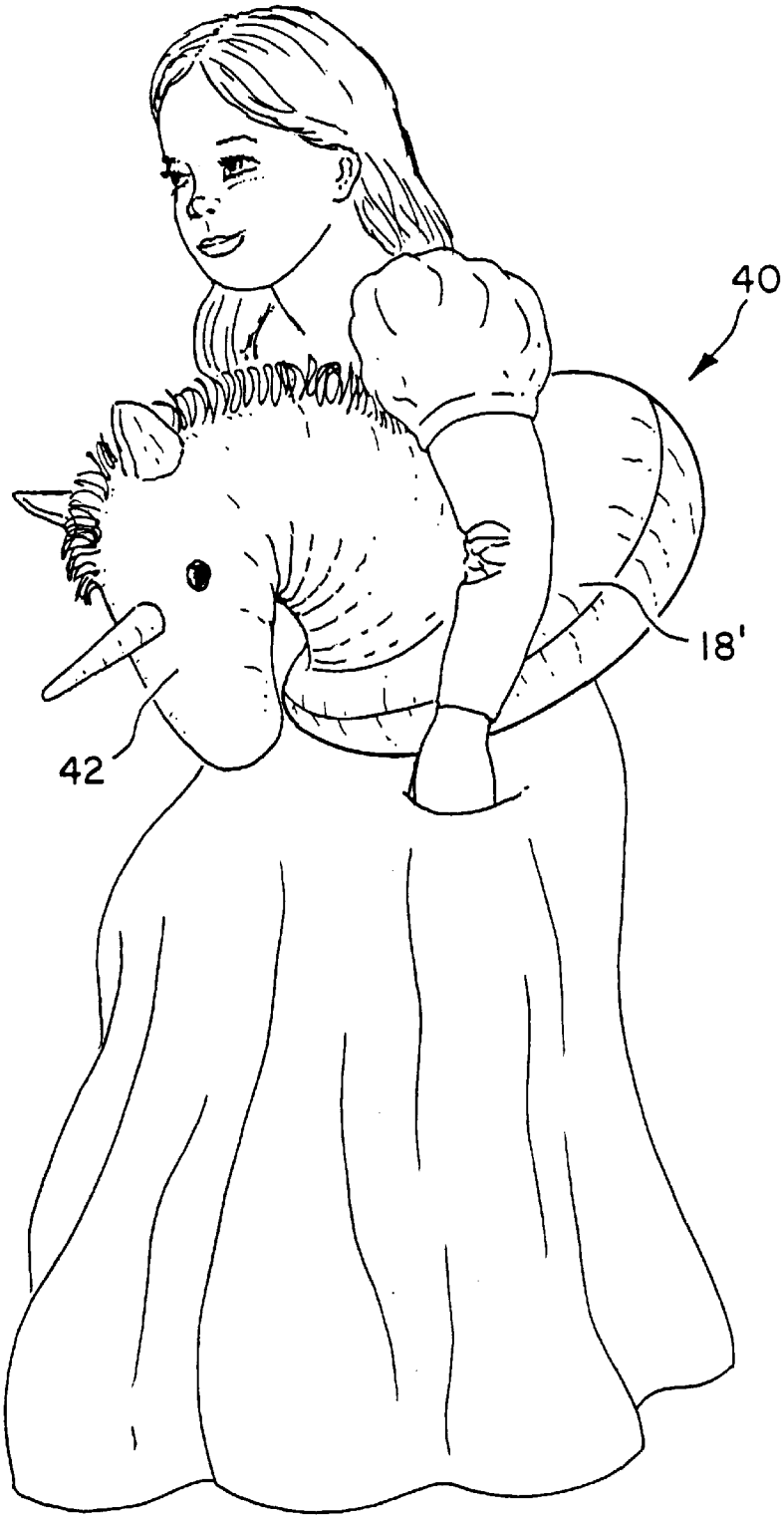

Referring now to FIGS. 10 and 11, exemplary uses of the support pillow 40 will be described. In FIG. 10, the support pillow 40 is placed around the person's torso with the cantilever arms 18', 20' being around the person's waist or lower torso, and with the head member 42 being in front of the person's torso. In this way the person may rest the head, neck, or chest on the head member when in a sitting position.

As illustrated in FIG. 11, the support pillow 40 may be placed around the person's torso when in the standing position. In this manner, the person may conveniently walk about with the support pillow 40 held around the torso, and with the head member 42 being at a comfortable viewing distance in front of the person. When the person sits, the support pillow 40 may be employed to rest his or her arms on the cantilever arms 18', 20'.

Referring to FIG. 12, a bottom portion 44 of the support pillow 40 is preferably constructed of a material which is suitable for receiving ink from a pen 46, marker, or similar writing instrument. Preferably, the bottom portion 44 will be constructed of a fabric having a smooth surface, such as satin, non-rip nylon, and the like. In this manner, the support pillow 40 may be used to receive autographs or other messages, such as when used at a slumber party, or to personalize the support pillow 40.

Referring to FIGS. 13 and 14, an exemplary device and method for storing and displaying a support pillow 50 will be described. Support pillow 50 includes a medial region 52 and two opposing arms 54 and 56, and may be constructed similar to the support pillows previously described herein. Surrounding medial region 52 is a central holder 58. Holder 58 preferably comprises a generally flexible material, such as cardboard, cardstock, plastic, and the like which is secured around medial region 52 to provide a convenient way to hold and display the support pillow 50. Preferably, holder 58 includes a tab 60 having an aperture 62 extending therethrough to enable the support pillow to be hung from a hanger 64 as shown in phantom line in FIG. 14.

Hence, by providing holder 58, support pillow 50 may be conveniently hung from a conventional hanger along an aisle of a retail store. Such a display is advantageous in that it reduces the amount of space required to store multiple support pillows. Further, by displaying the support pillow in this manner, purchasers are able to easily visualize the support pillow when passing down the aisle, therefore increases the chances for selling the pillow.

Upon removal from the hanger, a purchaser may simply remove holder 58, e.g., by tearing it from the support pillow, whereupon the support pillow 50 will be available for use. Optionally, a protective cover 66, such as a piece of clear plastic, may be provided over the support pillow 50 to protect the pillow from dirt and dust during storage. The protective cover 66 may simply be removed from pillow 50 prior to use.

Figure 15:
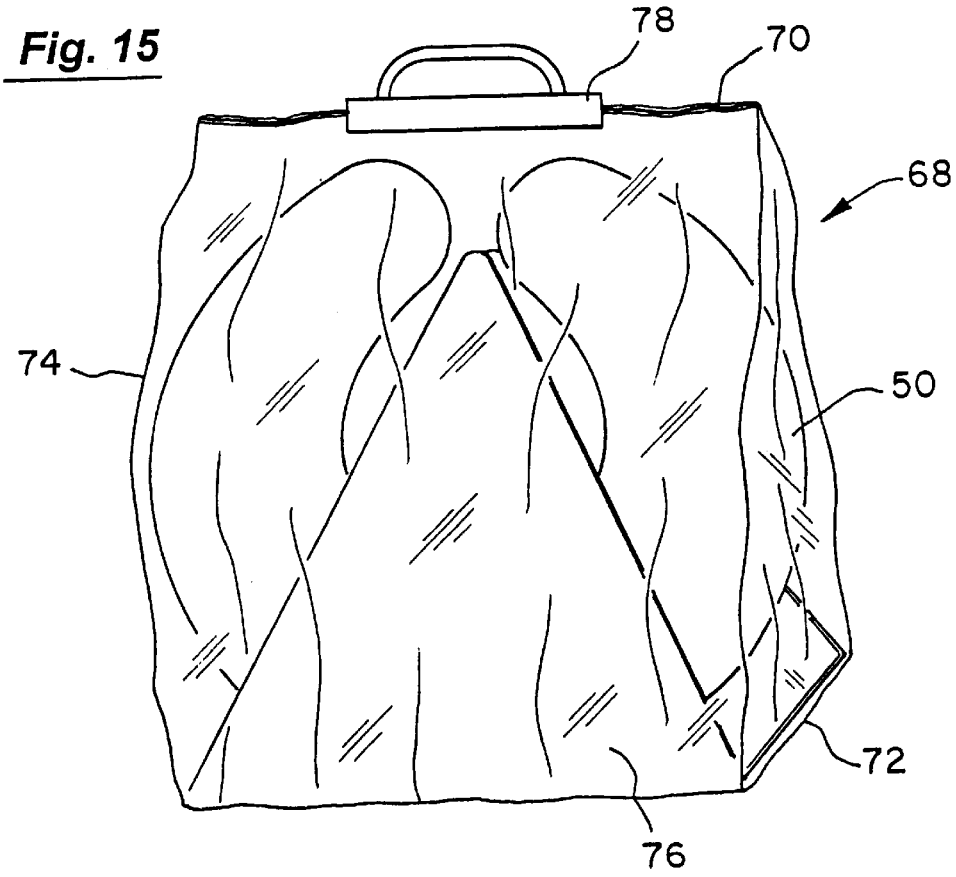
FIG. 15 is a front perspective view of a support pillow which is stored within a container according to the invention.

Referring now to FIG. 15, an exemplary container 68 for holding support pillow 50 will be described. Container 68 is constructed of a flexible material, such as a clear plastic, and has an open top end 70, a bottom end 72 and sides 74. Held within container 68 is a base member 76 which is preferably constructed of a rigid or semi-rigid material, such as cardboard or cardstock, which is folded so that it is flat on the bottom. In this way, when pillow 50 is placed in container 68, medial region 52 will rest on base member 76, which in turn will hold pillow 50 in a generally vertical orientation.

Conveniently, a snapable handle 78 is provided for carrying container 68. When snapped together, handle 78 also closes top end 70 to enclose pillow 50 within container 68. Hence, with such an arrangement, pillow 50 may conveniently be stored and displayed in a vertical orientation, while being able to be conveniently carried simply by grasping handle 78. To remove pillow 50 from container 68, handle 78 is separated and pillow 50 is lifted from container 68.

Figure 16:
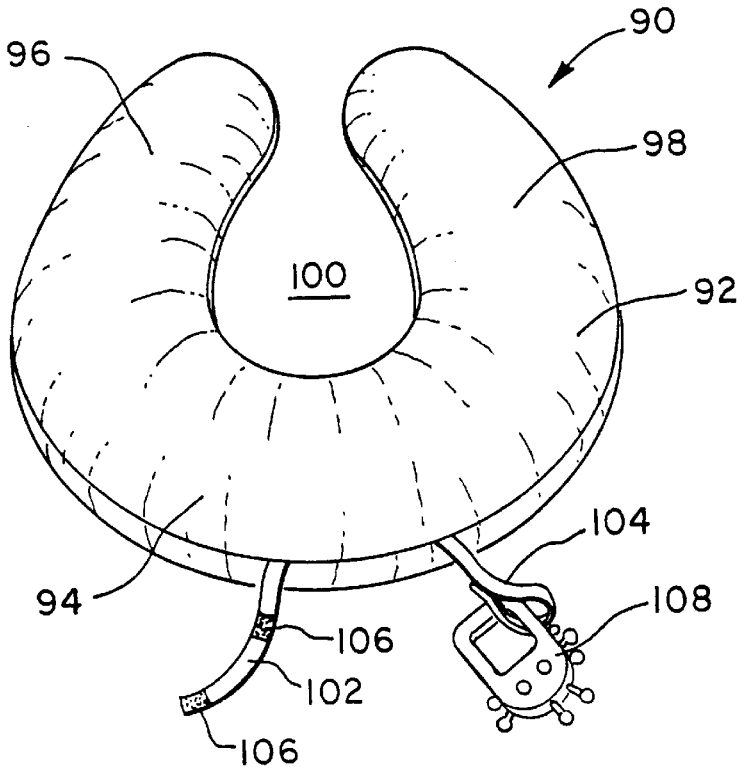
FIG. 16 is a top perspective view of a support pillow having a plurality of straps for attaching articles to the pillow according to the invention.

Referring now to FIG. 16, another exemplary embodiment of a support pillow 90 will be described. Support pillow 90 comprises a resilient cushion body 92 having a medial region 94 and two arms 96, 98 to define a generally open well 100. Support pillow 90 may be constructed similar to the other support pillows described herein.

Attached to medial region 94 are a pair of straps 102, 104, it being appreciated that other numbers of straps may be attached to the cushion body at other selective locations. Straps 102, 104 are preferably constructed of a strong, flexible material, such as cloth, nylon, and the like and may conveniently be sewn into the seam of the pillow body cover. As shown, each strap includes hook and loop fastener material 106, commonly sold under the tradename of Velcro (see strap 102). As best shown with strap 104, fastener material 106 allows strap 104 to be formed into a loop to hold a toy 108 to cushion body 98.

Although the fastener is shown as a hook and loop material, it will be appreciated that other attachment schemes may alternative be provided. For example, toys could be attached by tying one or two straps around the toy. Alternatively, fasteners such as buckles, snaps, and the like could also be used with the straps.

In use, a child will preferably lay on the support pillow 90, with the stomach being generally over open well 100. The child's hands will then hang over medial region 94 so they are near straps 102 and 104. In this way, the toys held by the straps with always be within the child's reach. More specifically, the straps will prevent the child from pushing the toys out of reach during play and then becoming frustrated. In an alternative arrangement, the straps could be located at other areas on the pillow to allow the child to sit or lay in other orientations while playing with the toys. For example, the straps could be located on the arms to allow the child to lay across the arms or to sit in the well while playing with the toys.

Another advantage of the straps is that they allow for easy removal of the toys from the pillow. In this way, a variety of toys may be conveniently substituted so that the child will not become bored with the toys. Further, the toys may easily be removed for cleaning, repair or the like. The removable nature also allows the toys to be sold with the pillow as a system or a kit, or separately as replacement items.

The invention further provides a variety of support pillows that are configured to be inflatable. Such support pillows may be inflated to have essentially the same configurations and sizes of any of the support pillows described herein. Conveniently, the support pillows may be manually inflated by the user. As such, the support pillows may be deflated for storage and then inflated when needed for use. In this way, the amount of storage space can be greatly reduced. Moreover, in some cases manufacturing costs may also be reduced.

Such support pillows may be constructed of a pillow body having an open interior that is configured to be filled with a fluid, such as air or other gases. Conveniently, one or more inflation ports may be used to permit the support pillows to be manually inflated by a user. A wide variety of materials may be used to construct the pillow body so that it may be inflated. For example, the pillow body may be constructed of plastic, vinyl, rubber, or the like. Further, a variety of fabrication techniques may be used to construct the pillow body. As one example, the pillow body may be constructed of two halves that are welded or glued together along a center seam. However, it will be appreciated that other techniques may be used.

In some embodiments, material or structures may be attached to both the top and bottom sides of the support pillow and disposed in the interior of the support pillow to modify the shape of the support pillow when inflated. For example, a wall, post, strip of fabric, or the like may be attached to both the bottom and top sides to limit the vertical height of the support pillow when inflated. In this way, the amount of rounding on the top and bottom sides may be limited to generally flatten the top and bottom sides. This is advantageous in providing a relatively flat surface on the top and bottom sides when resting an object on the top and bottom sides. For example, when the pillow is used as a nursing pillow, the top and bottom sides may be generally flattened to facilitate placement of a baby onto one of the surfaces. These structures may be strategically placed within the interior of the pillow body to provide the desired shape of the pillow upon inflation. Merely by way of example, multiple walls may be placed in the pillow body so that they extend radially outward from the interior wall. However, it will be appreciated that other configurations may be used as well. When constructed of a plastic material, these walls may be welded or otherwise attached to both the top and bottom pieces, and then the top and bottom pieces in turn may be welded or attached together. Further, one or more air flow channels may be provided within the interior so that the entire pillow may be inflated using a single inflation port.

Optionally, a fabric cover may be provided over the inflated pillow body to provide an aesthetically pleasing exterior surface. The cover may be configured to be removable or may be permanently sewn about the pillow body. Examples of covers that may be used include those described in U.S. application Ser. No. 09/802,310, filed Mar. 8, 2001, now U.S. Pat. No. 6,453,493 the complete disclosure of which is herein incorporated by reference. Further, any of the fabric shells described herein may also be used, including those with various attachment mechanisms.

Another advantage of using such interior walls is that the pillow body may be fully inflated without distorting the overall shape of the pillow body. In this way, the pillow body may be relatively firm so that it may provide adequate support to the user.

Figure 17:
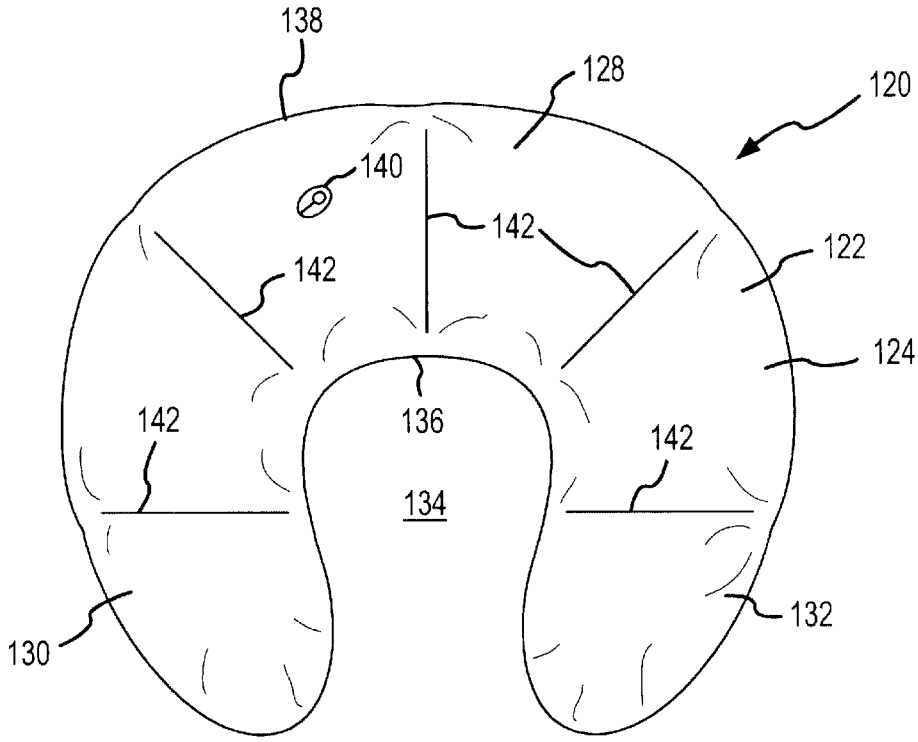
FIG. 17 is a top view of an inflatable support pillow according to the invention.
Figure 18:
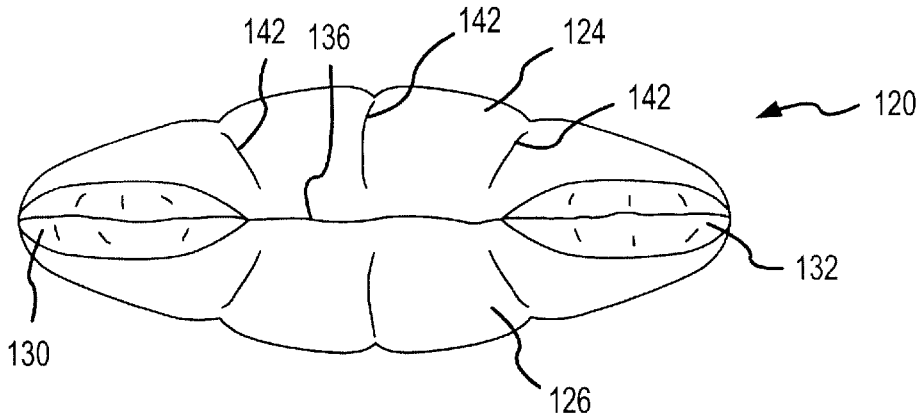
FIG. 18 is a side view of the inflatable support pillow of FIG. 17.

Referring now to FIGS. 17 and 18, one embodiment of an inflatable support pillow 120 will be described. Support pillow 120 comprises a pillow body 122 that is shown in the inflated configuration. Pillow body 122 may conveniently be defined in terms of a top side 124 and a bottom side 126. Similar to the other support pillows described herein, pillow body 122 has a medial region 128 and two opposing arms 130 and 132. The overall dimension of pillow body 122 may be similar to any of the embodiments described herein. Further, in some cases it will be appreciated that pillow bodies which are larger or smaller than the dimensions set forth herein may also be provided.

Arms 130 and 132 are generally curved to form an open well 134. Surrounding well 134 is an interior perimeter 136. The outer portion of pillow body 122 also includes an outer perimeter 138.

Pillow body 122 may conveniently be formed of a plastic material. To construct pillow body 122, the plastic pieces that form top side 124 and 126 may be separate and then welded or glued together along a seam zone that is formed along inner perimeter 136 and outer perimeter 138. Once these two pieces are joined together, they form a generally open interior. Conveniently, an inflation port 140 may be provided to permit a user to inflate pillow body 122. Inflation port 140 may comprise a plastic or rubber tube having an end cap that is placed over the opening once inflated.

To help maintain top side 124 and bottom side 126 generally flat during inflation, a plurality of walls 142 may be attached to top side 124 and bottom side 126 and be disposed within the interior of pillow body 122. When pillow body 122 is inflated, walls 142 limit the amount of vertical movement of top side 124 and bottom side 126 relative to each other as best shown in FIG. 18. Hence, by limiting the size of walls 142, the amount of vertical inflation may also be limited. Further, by constructing walls 142 to be generally straight, they assist in flattening out top side 124 and bottom side 126 as illustrated in FIG. 18. In this way, the amount of rounding of top side 124 and bottom side 126 is reduced to increase the amount of generally flat surface area available for resting an object. As such, the overall shape may be more similar to the embodiments previously described herein. Furthermore, by limiting the shape in this manner, pillow body 122 may be fully inflated so that it is sufficiently firm without contorting the overall shape.

Walls 142 may conveniently be bonded or glued to top side 124 and bottom side 126 prior to joining top side 124 to bottom side 126. Further, one or more gaps may be provided between walls 142 and the outer or inner perimeter of pillow body 122 so that gas flow channels are provided throughout the interior of pillow body 122. In this way, a single inflation port may be used to inflate the entire pillow body.

As shown, walls 142 extend radially outward from wall 134. Further, the number of walls is five in number. However, it will be appreciated that other orientations and/or numbers of walls may be used. Further, walls 142 may be shorter in size and placed at various discrete locations to alter the overall shape of pillow body 122. For example, multiple narrow pieces of fabric may be judiciously positioned within the interior pillow body 122.

In the embodiment shown in FIGS. 17 and 18, walls 142 may have a vertical height in the range from about 2 inches to about 8 inches. Further, walls 142 may be separated by a distance in the range from about 3 inches to about 10 inches. However, as just described, other configurations of walls may be used.

Although not shown, it will be appreciated that a fabric cover may be provided over pillow body 122. This may be removable, i.e., by providing a zippered accessway so that various covers may be provided about pillow body 122. Alternatively, the fabric cover may be integrally sewn over pillow body 122.

The present invention has been described in detail. However, modifications and variations may occur to those skilled in the art without departing from the principles of the claimed invention. Therefore, the scope of the invention should be determined primarily with reference to the appended claims, along with a full scope of equivalents to which those claims are entitled by law.

What is claimed is:

1. A support pillow, comprising:

an inflatable pillow body having an interior that is adapted to be filled with a fluid to inflate the pillow body, a top side, a bottom side, and a plurality of walls disposed in the interior and that connects the top side to the bottom side to facilitate flattening of the top and the bottom sides when the pillow body is inflated, wherein the walls have a height in the range from about 2 inches to about 8 inches, and wherein the pillow body further comprises a medial region and first and second opposing arms extending from the medial region, wherein the arms have respective first and second end portions remote from the medial region, wherein the arms are curved about a vertical axis, and wherein the arms and medial region cooperate to define an open well, and wherein the walls extends radially outward from the well and are spaced apart by a distance in the range from about 3 inches to about 10 inches.

2. A support pillow as in claim 1, wherein the pillow body is constructed of a material selected from a group consisting of rubber and vinyl.

3. A support pillow as in claim 1, wherein the top and the bottom sides comprise separate pieces of material that are attached to each other.

4. A support pillow as in claim 1, further comprising an inflation port that is adapted to permit fluids to be introduced into and removed from the interior of the pillow body.

5. A support pillow as in claim 1, further comprising at least one passage between the pillow body and the wall to permit the fluid to flow around the wall.

6. A support pillow as in claim 1, further comprising a fabric cover disposed about the pillow body.

7. A method for making a support pillow, comprising:

providing an inflatable pillow body having an interior that is adapted to be filled with a fluid to inflate the pillow body, a top side, and a bottom side, and wherein the pillow body further comprises a medial region and first and second opposing arms extending from the medial region, wherein the arms have respective first and second end portions remote from the medial region, wherein the arms are curved about a vertical axis, and wherein the arms and medial region cooperate to define an open well;

attaching a plurality of walls to the top and bottom sides and then attaching the top side to the bottom side, and wherein the wall extends radially outward from the well, are spaced apart by a distance in the range from about 3 inches to about 10 inches, and have a height in the range from about 2 inches to about 8 inches to facilitate flattening of the top and the bottom sides when the pillow body is inflated; and inflating the pillow body.

8. A method as in claim 7, further comprising placing a fabric cover about the pillow body.

* * * * *